US006804829B2

(12) United States Patent
Crye et al.

(10) Patent No.: US 6,804,829 B2
(45) Date of Patent: Oct. 19, 2004

(54) ADVANCED COMBAT HELMET SYSTEM

(75) Inventors: Caleb Clark Crye, Brooklyn, NY (US); Eric Owen Fehlberg, Queens, NY (US)

(73) Assignee: LineWeight LLC, Brooklyn, NY (US)

( * ) Notice: Subject to any disclaimer, the term of this patent is extended or adjusted under 35 U.S.C. 154(b) by 25 days.

(21) Appl. No.: 10/244,090

(22) Filed: Sep. 13, 2002

(65) Prior Publication Data

US 2003/0070200 A1 Apr. 17, 2003

Related U.S. Application Data

(60) Provisional application No. 60/322,026, filed on Sep. 14, 2001.

(51) Int. Cl.[7] ..... F41H 1/04

(52) U.S. Cl. ..... 2/6.6; 2/9; 2/10; 2/421; 2/424

(58) Field of Search ..... 2/6.6, 6.3, 6.5, 2/6.7, 6.8, 411, 412, 414, 415, 417, 418, 419, 421, 422, 424, 10, 453, 173, 9

(56) References Cited

U.S. PATENT DOCUMENTS

| | | | | | |
|---|---|---|---|---|---|
| 1,231,766 | A | * | 7/1917 | Mahan | 2/6.6 |
| 1,294,863 | A | * | 2/1919 | Blaszko | 2/6.6 |
| 1,366,907 | A | * | 2/1921 | Dunand | 2/6.7 |

(List continued on next page.)

FOREIGN PATENT DOCUMENTS

| | | | | |
|---|---|---|---|---|
| FR | 1446416 A | * | 6/1966 | |
| FR | 2593037 A1 | * | 7/1987 | A42B/3/04 |
| GB | 54440 | * | 10/1974 | |

OTHER PUBLICATIONS

"Flight Helmet A", undated, 1 p.
"Flight Helmet B", undated 1 p.
"HGU–68/P", website printout http://www.flighthelmet-.com/pages/fh/fhitempage/pfh1011.htm, Sep. 9, 2003, 2 pp.
"Tactical Ballistic Helmet (TBH)" website printout http://www.gentexcorp.com/Armor/TBH.htm, Sep. 12, 2002, 2 pp.
"The EPS–21 Goggle System" website printout http://www.gentexcorp.com/Armor/EPS–Tac.htm, Sep. 12, 2002, 2 pp.

*Primary Examiner*—Rodney M. Lindsey
(74) *Attorney, Agent, or Firm*—Stiennon & Stiennon

(57) ABSTRACT

A military or police helmet system 20 has a flexible plastic liner 24 mounted to the wearer's head 26 by a strap assembly 28 . A ballistic shell 30 with a shallow front wall is fastened to the liner 24 and an eye shield assembly 32 is pivotably mounted to the liner for movement between a deployed position and a retracted position between the shell and the liner. The liner has a rear segment connected to a cap segment, with cut-out slots which allow the liner to apply pressure to the wearer's neck. A chin strap is slidable on two stiff side straps which have curved segments allowing the chin strap to move with the user's jaw. A protective face guard assembly 34 engages with the liner and has openings covered by resilient sheets which permit a marksman feel a rifle stock through the face guard.

19 Claims, 3 Drawing Sheets

U.S. PATENT DOCUMENTS

| | | | | | |
|---|---|---|---|---|---|
| D135,765 | S | | 6/1943 | Wulsin | |
| 2,340,872 | A | * | 2/1944 | Flynn et al | 2/6.6 |
| 2,889,555 | A | * | 6/1959 | Stuart et al. | 2/6.6 |
| 3,009,158 | A | * | 11/1961 | Comeau et al. | 2/437 |
| 3,691,565 | A | * | 9/1972 | Galonek | 2/431 |
| 3,714,668 | A | * | 2/1973 | Mirabella | 2/419 |
| 3,787,895 | A | * | 1/1974 | Belvedere | 2/9 |
| 3,833,935 | A | | 9/1974 | Ansile et al. | |
| 3,871,026 | A | * | 3/1975 | Dorre | 2/410 |
| 3,906,546 | A | * | 9/1975 | Gooding | 2/414 |
| 3,991,423 | A | * | 11/1976 | Jones | 2/415 |
| 4,042,974 | A | * | 8/1977 | Morgan et al. | 2/9 |
| 4,156,292 | A | | 5/1979 | Helm et al. | |
| 4,287,615 | A | * | 9/1981 | Morin | 2/424 |
| 4,364,636 | A | | 12/1982 | Ellis | |
| D268,220 | S | | 3/1983 | Gooding | |
| 4,477,929 | A | * | 10/1984 | Mattsson | 2/425 |
| D291,127 | S | * | 7/1987 | Bohjort | D29/105 |
| 4,741,054 | A | * | 5/1988 | Mattes | 2/421 |
| 4,953,234 | A | * | 9/1990 | Li et al. | 2/412 |
| D320,477 | S | | 10/1991 | Hassfuther | |
| 5,448,780 | A | | 9/1995 | Gath | |
| 5,603,117 | A | | 2/1997 | Hudner, Jr. et al. | |
| 5,940,891 | A | | 8/1999 | Lane | |
| 6,266,827 | B1 | * | 7/2001 | Lampe et al. | 2/414 |
| 6,282,726 | B1 | | 9/2001 | Noyerie et al. | |
| 6,339,849 | B1 | * | 1/2002 | Nelson et al. | 2/425 |
| 6,438,763 | B2 | * | 8/2002 | Guay et al. | 2/424 |

* cited by examiner

ADVANCED COMBAT HELMET SYSTEM

CROSS REFERENCES TO RELATED APPLICATIONS

This application claims the benefit of U.S. Provisional application No. 60/322,026, filed Sep. 14, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to protective headgear in general, and in particular to apparel which protects the head and face of military and police personnel in conflict situations.

Protective helmets have been developed to suit a wide range of human endeavors which present risks of head injury. Police and military applications however, are especially challenging as not only must accidental injuries be protected against, but also sudden and intentional assaults which have as their purpose the injury of the helmet wearer.

Military and police helmets will be worn in difficult and unpredictable conditions and are often the difference between surviving or perishing in a combat situation. Although a premium is placed on the protective qualities of the helmet, especially in deflecting or blocking penetration by projectiles, shrapnel, and flying debris; comfort and long-term ease-of-use are also essential. Fighting forces must often stay on alert for extended periods and the protective helmet should not be a cause of fatigue. Moreover, a comfortable and well fitted helmet is more likely to be worn, and thus be ready to fulfill its protective function in an emergency. Because military and police personnel are often called to duty on a moment's notice, a helmet should also be capable of being put on speedily while requiring minimal attention. In addition, despite the need to protect the wearer from external threat, the helmet system should interfere as little as possible with the performance of martial duties such as discharging a rifle.

Military helmets in the era of mechanized warfare have progressed from rudimentary shallow steel shells held in place with woven straps, such as used in the trenches of World War I, to the arimid fiber PASGT (Personal Armor System, Ground Troops) helmet which has been used by U.S. forces in late 20th Century conflicts. Nevertheless, greater functionality, convenience, and comfort are highly desirable in supporting efforts of military and police personnel.

SUMMARY OF THE INVENTION

The combat helmet system of this invention employs a structural helmet liner formed of stiff but resilient plastic material to which a protective ballistic shell, an eye shield, a face mask, or other accessories are mounted as to a chassis. The plastic liner has an upper cap segment integrally formed with a rear segment which is divided from the cap segment at the sides along two spaced V-shaped slots. The rear segment is molded such that when it is worn, it is displaced rearwardly, thereby applying a spring force to the back of the wearer's neck, creating an over-center retention system. A stiff side strap extends between the cap segment and the rear segment of the liner on each side of the wearer, keeping the region around the wearer's ear clear for operation of radio transceivers and the like. The side straps are connected by a forward chip strap which slides on curved segments of the side straps to allow the strap to move as the wearer's jaw moves. The ballistic shell has a shallow angle deflection brim which projects frontwardly from the liner. A pivotable eye shield is fixed to the liner and is retractable by a pair of over-center spring connections to a position overlying the liner and beneath the ballistic shell. A removable face guard has a structural frame defining openings on each side of the wearer's face which may be solid or covered with a sheet of flexible material to permit the gunstock of a shoulder mounted weapon to engage the wearer's face for effective operation and use of the weapon's sights.

It is an object of the present invention to provide a combat helmet system which is rapidly put on and taken off.

It is another object of the present invention to provide a combat helmet system which has a protective face mask which allows a marksman to feel the stock of a shoulder weapon through the mask.

It is a further object of the present invention to provide a combat helmet system which is securely and comfortably attachable to a wearer.

It is an additional object of the present invention to provide a combat helmet system which allows the wearer's jaw to move while retaining the secure engagement of the helmet.

It is yet another object of the present invention to provide a combat helmet system with a retractable eye shield which is protected from exposure when in its retracted position.

It is a still further object of the present invention to provide a combat helmet system with an eye shield which engages the wearer's face when in a deployed condition.

Further objects, features and advantages of the invention will be apparent from the following detailed description when taken in conjunction with the accompanying drawings.

DESCRIPTION OF THE PREFERRED EMBODIMENTS

Figure 1:
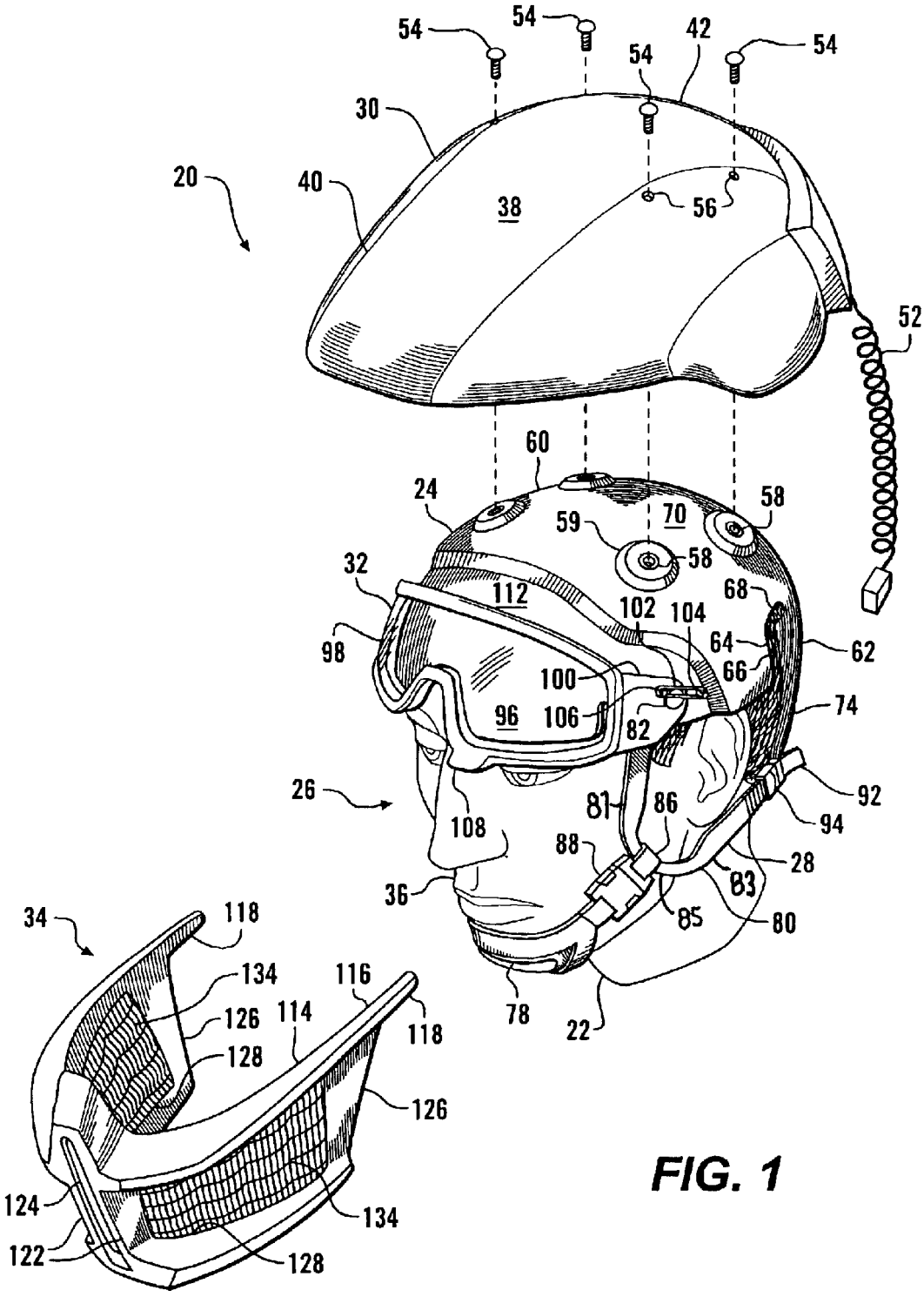
FIG. 1 is an exploded isometric view of the combat helmet system of this invention.
Figure 2:
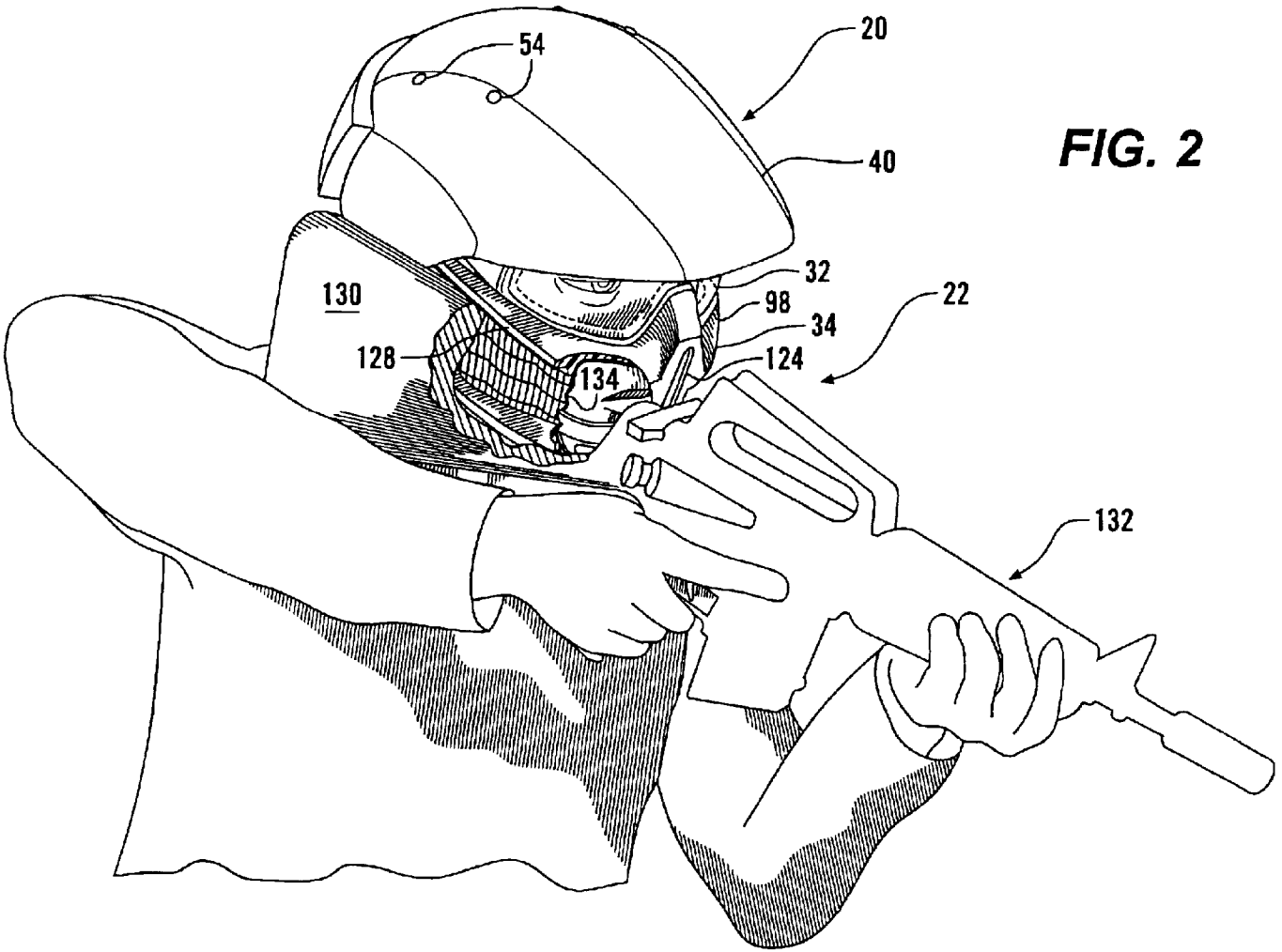
FIG. 2 is a perspective view of the combat helmet system of this invention in use by a soldier.
Figure 3:
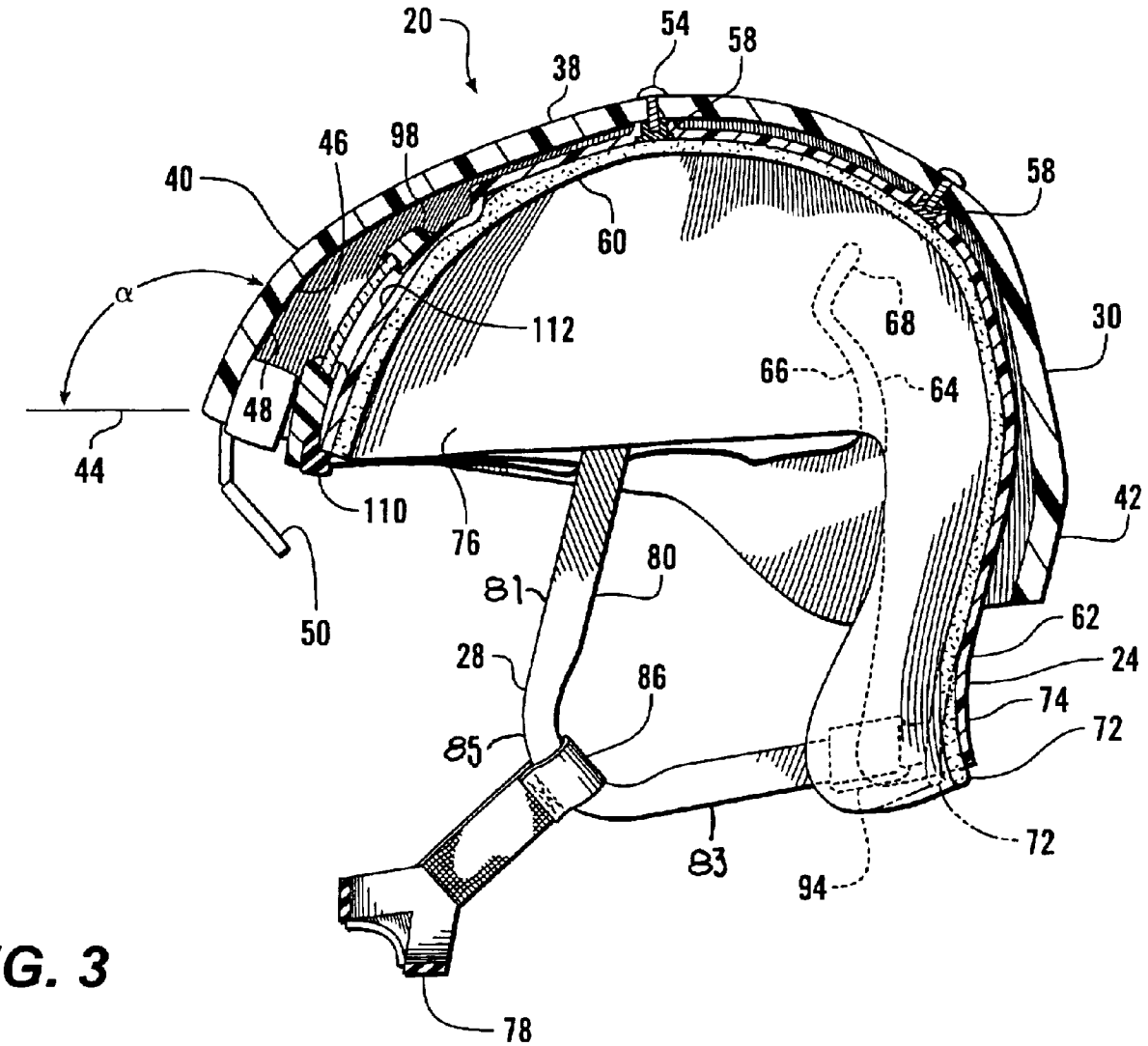
FIG. 3 is a cross-sectional view of portions of the helmet system of FIG. 1.
Figure 3:
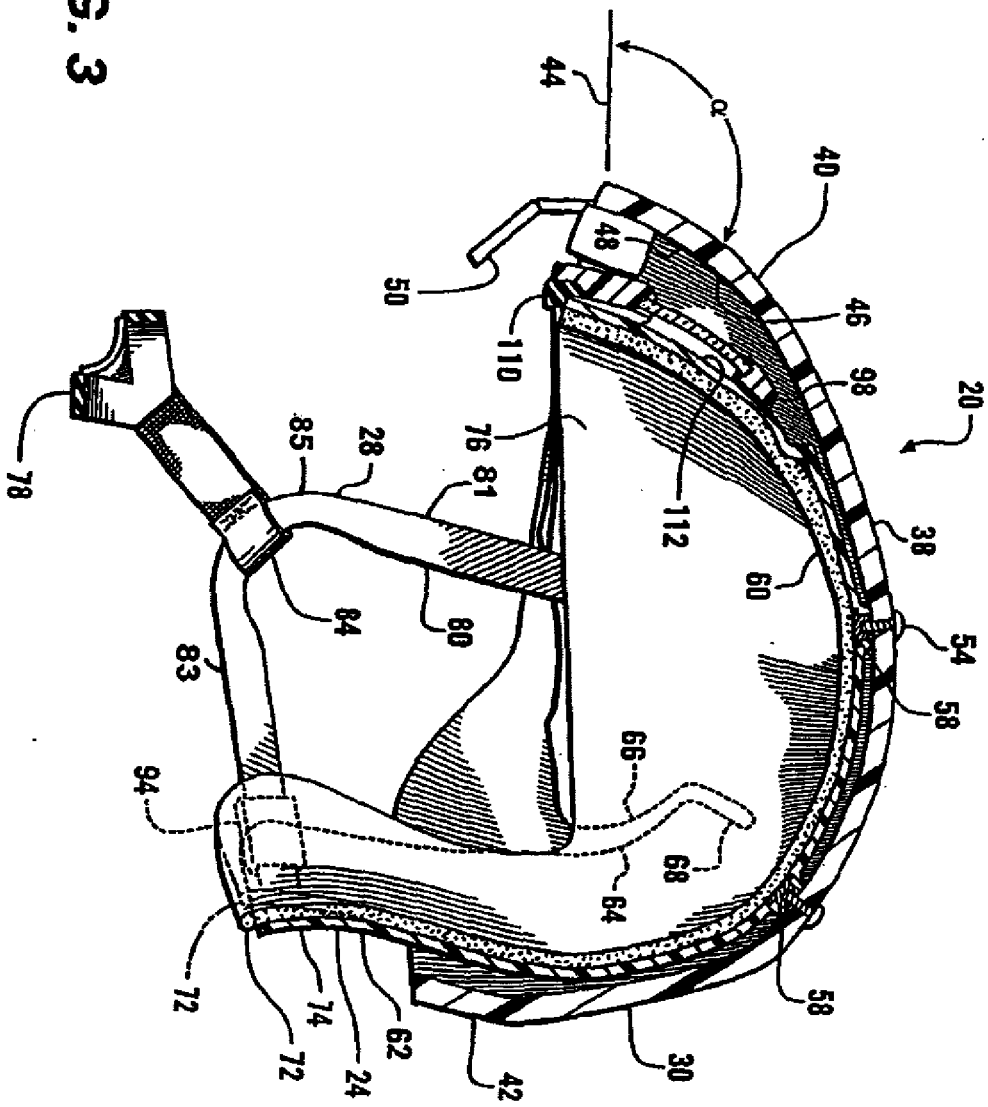

Referring more particularly to FIGS. 1–3, wherein like numbers refer to similar parts, a combat helmet system 20 is shown with respect to a soldier 22 in FIG. 1. The system 20 has a flexible plastic liner 24 which is mounted to the wearer's head 26 by a strap assembly 28. A ballistic shell 30 is fastened to the liner 24 and a goggle or eye shield assembly 32 is pivotably mounted to the liner for movement between a retracted and a deployed position. An optional face guard assembly 34 engages with the liner to protect the wearer's face 36 and filter breathable air while still permitting the soldier 22 to operate a rifle in a conventional fashion.

As shown in FIG. 3, the ballistic shell 30 may be molded of conventional infantry helmet material, preferably Kevlar material produced by E. I. du Pont de Nemours and Company or PBO fibers, or the like. The ballistic shell 30 may be formed of other high performance ballistic materials such as titanium, alumina-ceramics, and high-strength composites. The shell material may also be provided with various known slippery coatings and finishes to increase the tendency of projectiles to deflect or skim off of the shell's surface. The ballistic shell 30 has a top wall 38 with a frontwardly extending deflection brim 40 and a rearwardly and downwardly extending rear wall 42. The deflection brim 40 has a shallow angle at with respect to a horizontal plane 44. The path of an incoming projectile such as a rifle bullet will generally be parallel to the horizontal plane 44 when the wearer of the helmet is standing upright. Whereas in a conventional prior art helmet, the front of the helmet might define an angle of about 95 degrees with the horizontal, in the illustrated ballistic shell 30, this angle $\alpha$is between about 110 degrees and 135 degrees, and is preferably between 120 and 135 degrees, with about 120 degrees being optimal. Projectiles which strike the ballistic shell 30 at a higher angle are more likely to skim off or be deflected from the shell than projectiles which approach the shell more nearly perpendicular to its surface. However, once the angle becomes too great, less protection for the front of the head is provided with a reasonably sized shell.

Because the deflection brim 40 protrudes frontwardly beyond the liner 24, a pocket 46 is defined between the inside surface 48 of the deflection brim and the front of the liner. This pocket provides room for attachment of various accessories to the ballistic shell 30, for example a heads-up display 50, light sources, or other optical equipment. As shown in FIG. 1, a power and data cord 52 may extend from the electronic equipment within the ballistic shell 30 for connecting the electronics to power supplies, transceivers, or other equipment worn on the wearer's body. Moreover, the added distance between the front surface of the ballistic shell and the liner allows for a greater back-face deformation of the shell in the region of the deflection brim without making contact with the wearer. In addition, the wider brim serves to shield the eyes and face of the wearer from heat and glare of the sun, and from overhead burst munitions. Also, the deflection brim 40 improves the multi-spectral camouflage of the head from various sensors. For example, more of the face will be in shadow and thus more difficult to view from overhead sensors.

As shown in FIG. 1, the liner 24 is fastened to the ballistic shell 30 by four threaded fasteners 54 which extend through drilled holes 56 in the top wall 38 of the ballistic shell. The fasteners 54 engage with threaded plastic retainers 58 which are inmolded with the liner 24. The retainers 58 are surrounded by projecting standoffs 59 which engage the interior of the ballistic shell, and space the majority of the liner from direct contact with the ballistic shell. This greater spacing restricts the injury to the wearer when a projectile which does not penetrate the shell nevertheless dents or dimples it.

The liner 24 is formed of a stiff plastic, such as nylon, and is approximately 1/16 of an inch thick. However, although the plastic of the liner 24 is not cushiony or rubbery, the thin cross-section of the liner makes it somewhat resilient or springy such that parts of the liner may flex with respect to other parts. As best shown in FIG. 3, the liner has a cap segment 60 which overlies most of the crown of the wearer's head 26 and a rear segment 62 which is joined to the cap segment 60 and integrally formed therewith. The cap segment 60 descends to a level above the wearer's ears, while the rear segment extends downwardly below ear level to engage the upper neck of the wearer at about chin level.

The connection between the cap segment 60 and the rear segment 62 is principally along the top, while the lower parts of the cap segment are separated from the rear segment by two generally V-shaped slots 64, one on the left side of the liner 24, and one on the right side. Each slot 64 has a first section 66 which extends frontwardly and upwardly and a second section 68 which extends rearwardly and upwardly from the first section and which defines approximately a 90 degree angle with respect to the first section.

The slots 64 divide the liner 24 and define a hinge region 70 which extends across the top of the liner 24 and extending between the two slots. Hence, the rear segment 62 may flex with respect to the cap segment 60. As shown in phantom view in FIG. 3, the liner is preferably molded such that the bottom edge 72 of the rear segment 62 is positioned frontwardly from its intended position when worn on a wearer's head. When the wearer dons the helmet system 20, the bottom edge 72 is flexed rearwardly, as shown in solid view in FIG. 3, and a resilient spring force is applied to the back of the wearer's neck at a neck segment 74 of the liner rear segment 62. The neck segment 74 thus has spring and memory, and serves to apply pressure at the rear of the helmet. The rear segment is shaped to fit up against the base of the wearer's skull, above the back of the neck. This provides for a snug and comfortable fit, and prevents the helmet from moving around on the wearer's head. An over center fit is thus created.

The wearer's head does not directly engage the plastic liner 24 but is cushioned by a soft liner pad 76, shown in FIG. 3, which is fastened to the interior of the liner 24. The pad 76 may be formed of felt or other fibrous or cushioning material and may be permanently affixed by adhesive, or may be removably mounted, such as by hook and loop fastener systems. Because the pad 76 is flexible, it may extend unbroken over the interior of the slots 64.

The helmet system 20 is secured to the wearer's head 26 by a chin strap 78 which is connected to two side straps 80. Each side strap 80 is fastened to the cap segment 60 of the liner 24 at a position forward of the ear. The connection may be, for example, by the fastener 82 which pivotably connects the eye shield assembly 32 to the liner. Although the side straps may be formed of a rigid core encapsulated within fabric webbing, preferably, the side straps 80 are formed of molded rigid plastic elements. Thus the side straps 80 remain in the correct position when the helmet system 20 is removed from the head and do not become tangled. This facilitates the rapid putting on of the helmet since there is no need to disentangle the straps 80. Each side strap 80 has a generally vertical segment 81 which is joined to a generally horizontal segment 83 by a semi-circular intermediate segment 85.

The chin strap 78 terminates in a left loop 84, shown in FIG. 3, and an opposing right loop 86, shown in FIG. 1, which connect the chin strap to the side straps 80. A single mechanical buckle 88 is positioned on the chin strap for rapid release and connection. Each chin strap loop 84, 86, is fitted around one of the side strap 80 intermediate segments 85, thus allowing the chin strap to slide up and down for a short distance, allowing the wearer to move his jaw to speak, while maintaining a constantly tight fit. The curved intermediate segments 85 allow the loops 84, 86 to slide without significant tightening of the straps as the wearer moves his jaw. The intermediate segments 85 have a generally circular cross section, while the vertical segments 81 and the horizontal segments 83 of the side straps 80 are flattened and wider than the intermediate segments, preventing the loops 84, 86 from traveling too far upwardly or rearwardly. Alternatively, all the segments 81, 83, and 85 may be generally rectangular in cross section, with the intermediate segments having a small circumference to restrict movement of the chin strap loops off the intermediate segment.

To facilitate the comfortable operation of the chin strap while the wearer is speaking, and hence moving his jaw, it is preferable that the inner radius of the curved intermediate segment be about one inch or less. If this radius is too large, the helmet may tip back and forth on the head. Moreover, the center point defined by that radius should lie approximately over or near the point of rotation of the wearer's jaw, so that the wearer's jaw and the chin strap rotate about the same or nearly the same axis. In practice, the axis may be positioned just below the ear, to allow access to the ear for headphones or ear protection.

The rear end 92 of each side strap is connected to the liner rear segment 62 neck segment 74, and is preferably engaged with a ratchet mechanism 94. A separate ratchet mechanism may be provided for each side strap, as shown, or preferably a single ratchet mechanism may be provided at the rear of the neck segment which engages both side straps so that the fit of the element may be adjusted by, for example, rotating a single ratchet knob. By tightening the side straps, pressure is applied to the wearer's neck, and if necessary, the rear segment of the liner is caused to pivot with respect to the cap segment of the liner.

The eye shield assembly 32 has a transparent lens 96 which is retained within a rigid frame 98. The eye shield frame 98 has two rearwardly extending side arms 100 which are pivotably connected by the fastener 82 to the temples of the liner 24 at positions above and in front of the wearer's ears.

As shown in FIG. 1, resilient bands 102 form part of over center hinge attachments of the eye shield frame 98 to the liner 24. Each band 102 is looped around a first fixed mount 104 which protrudes from the liner 24 rearwardly and at about the same level as the axis of rotation defined by the pivotable fastener 82. Each band is also looped around a connection stud 106 fixed to the eye shield frame 98. The connection studs 106 are positioned such that when the eye shield assembly is retracted, as shown in FIGS. 1 and 3, each resilient band 102 applies a force which is above the level of the pivotable fastener 82 axis, and hence serves to hold the eye shield in a retracted position.

When it is desired to deploy the eye shield, the user engages a finger grip tab 108 protruding downwardly from the eye shield frame 98, and pulls the eye shield frame downwardly. Once the connection studs 106 pass below the pivotable fastener 82 axis, the resilient bands apply force along a line of force that is below the pivotable fastener 82 axis, and serve to retain the eye shield frame 98 in its deployed position. As shown in FIG. 3, the lower edge of the eye shield frame 98 has a resilient gasket 110, formed for example of rubber, foam, or neoprene rubber. This gasket 110 is pressed against the cheeks of the wearer, and forms a firm seal against the wearer's face, restricting the infiltration of dust.

When the eye shield assembly 32 is in its retracted condition it is stowed behind the primary protection provided by the ballistic shell 30. The eye shield assembly 32 is thus located in the pocket 46 defined between the liner 24 and the ballistic shell 30. This location not only helps to protect the lens 96 of the eye shield assembly 32, but also allows it to be closer to the wearer's face in its retracted condition, to give a tighter fit when it is deployed. The eye shield travels along a curved surface 112 on the front of the liner cap segment 60.

Alternatively, the eye shield may be retracted by three elastic bands, a center band fixed to the cap segment of the liner, and two side straps replacing the rigid pinned side arms of the embodiment shown. Such an eye shield may employ a central guide pin along the axis of force applied by the center band which travels within a slot formed in the liner, to guide the eye shield as it is retracted.

As shown in FIGS. 1 and 2, the helmet system 20 is provided with an optional face guard 34 which may be worn in situations of heavy dust, debris, or flying matter which requires protection of the wearer's face. The face guard 34 has a rigid frame 114 which has a top member 116 which curves around the wearer's face, as shown in FIG. 2, and passes below the deployed eye shield assembly 32. The face guard top member 116 has tabs 118 which extend rearward at about ear level to engage with the helmet. The tabs 118 may engage the liner 24 or the ballistic shell 30, although they will preferably engage the shell, for example by flexible straps which engage with snap clip fasteners on the shell, not shown. The face guard frame 114 has two front vertical members 122 which define a filter opening 124, and two rear vertical members 126. Between each front vertical member 122 and rear vertical member 126, a stock opening 128 is defined.

While the filter opening 124 is covered with a mesh, screen, or other air filter member, the stock openings 128 are each covered by a sheet 134 of flexible protective material through which the wearer's face can feel the shoulder stock 130 of a weapon 132. The flexible sheets 134 will typically not be air filtering material, but will be a protective air impervious material which will protect the wearer's face from low speed flying debris, dust, etc. The face guard 34 is shaped to allow a traditional shooting position with a rifle or other shoulder weapon, so that the wearer's eye is behind the sights, and the wearer's left or right cheek is able to contact the stock. The face guard allows the wearer's head to rest in such a manner that his eye is behind the sights of the weapon. This allows the correct use of the weapon's sights whether they are traditional iron sights, optical/telescopic, video/electronic, or any hybrid of any of these technologies.

Alternatively, the sheets 134 may be rigid, and formed as concave walls to accommodate the placement of the shoulder weapon stock for use by the wearer. It should be noted that the face guard 34 may be ballistically protective, for example by being formed out of Kevlar fibers or other ballistic protective material. The sheets 134 also may be integrally formed with the face guard frame 114.

It is understood that the invention is not limited to the particular construction and arrangement of parts herein illustrated and described, but embraces all such modified forms thereof as come within the scope of the following claims.

We claim:

1. A helmet system for protection of a wearer's head, comprising:

a ballistic shell having an interior;

a liner having a forward cap segment, and a rear segment resiliently connected to the cap segment and integrally formed with the cap segment, and portions of the rear segment below the cap segment define a neck segment, wherein the liner is fastened to the interior of the ballistic shell;

a resilient pad connected to the interior of the liner, the pad having portions attached to the interior of the neck segment, positioned to bear against a neck of the user;

a left side strap extending between the liner cap segment and the liner rear segment;

a right side strap extending between the liner cap segment and the liner rear segment and spaced opposite the left side strap; and a chin strap extending between and connecting the left side strap and the right side strap.

2. The helmet system of claim 1 further comprising an eye shield assembly mounted to the liner, and pivotable between a retracted position overlying the liner cap segment and positioned beneath the ballistic shell, and a deployed position overlying the eyes of the wearer.

3. The helmet system of claim 2 wherein the eye shield assembly has a frame, with at least one lens mounted thereto, and the frame has a first side arm which is pivotably connected to the liner cap segment at a first pivot mount above and forward of a wearer's first ear, and a second side arm which is pivotably connected to the liner cap segment at a second pivot mount above and forward of a wearer's second ear.

4. The helmet system of claim 3 further comprising a first resilient band which extends from a fixed mount on the liner cap rearward of the first mount to a connection on the eye shield frame forward of the first mount, the first resilient band extending above the first pivot mount when the eye shield assembly is in the retracted position, and the first resilient band extending below the first pivot mount when the eye shield assembly is in the deployed position.

5. The helmet system of claim 2 further comprising a resilient gasket extending along lower portions of the eye shield frame, such that when the eye shield assembly is overlying a wearer's eyes the resilient gasket engages with the face of the wearer.

6. The helmet system of claim 1 wherein the chin strap terminates in a left loop and an opposed right loop, and wherein the left side strap extends through the chin strap left loop, and the right side strap extends through the right loop, to permit slidable movement of the chin strap along the left side strap and the right side strap.

7. The helmet system of claim 1 wherein the ballistic shell has a frontwardly extending deflection brim, the brim having a surface which is inclined at at least a first angle with respect to a horizontal plane when the helmet system is worn by a wearer standing upright, wherein the first angle is between about 110 degree and 135 degrees, and wherein a utility compartment is defined between an underside of the deflection brim and the liner.

8. The helmet system of claim 7 wherein the first angle is about 120 degrees.

9. The helmet system of claim 1 wherein portions of the liner define two opposed slots between upper portions of the rear segment and rear portions of the cap segment, permitting the rear segment to flex with respect to the cap segment.

10. The helmet system of claim 9 wherein each of the two opposed slots comprises a first section which extends frontwardly and upwardly and a second section which extends rearwardly and upwardly from the first section and which defines approximately a 90 degree angle with respect to the first section.

11. The helmet system of claim 1 further comprising a face guard removably connected to the ballistic shell, the face guard having a frame which extends below the wearer's eyes and which covers portions of the wearer's nose to permit intake of air through said face guard, wherein portions of the frame define a concave outwardly opening rifle stock recess shaped to permit a rifle stock to be placed alongside the face guard and engaged within the recess to bring the rifle stock into close proximity to the wearer's face and to thereby permit the wearer to operate a rifle in a conventional fashion.

12. The helmet system of claim 11 wherein the rifle stock recess is defined by a sheet of flexible material secured to the face guard frame to overlie a rifle stock opening, the rifle stock opening being shaped to permit a rifle stock to be placed alongside the face guard and engaged with the sheet of flexible material to engage the rifle stock against the wearer's face with the sheet of flexible material between the wearer's face and the rifle stock.

13. A helmet system for protection of a wearer's head, comprising:

a ballistic shell having an interior;

a liner having a forward cap segment, and a rear segment connected to the cap segment, wherein the liner is fastened to the interior of the ballistic shell;

a left side strap and a right side strap, each formed of stiff material, and each having an upwardly extending segment which is connected to the liner cap segment, and a rearwardly extending segment which is connected to the liner rear segment and a curved intermediate segment connecting the side strap upwardly extending segment to the rearwardly extending segment, wherein the left side strap and the right side strap are spaced from each other on opposite sides of the liner; and a flexible chin strap which terminates in a left loop and an opposed right loop, and wherein the left side strap extends through the chin strap left loop, and the right side chin strap extends through the right loop, to permit slidable movement of the chin strap along the left side strap intermediate segment and the right side strap intermediate segment.

14. The helmet system of claim 13 wherein at least one of the side straps is engaged with a ratchet mechanism mounted to the liner, wherein adjustment of the engaged side strap in the ratchet mechanism adjusts the fit of the helmet on the wearer.

15. The helmet system of claim 13 wherein each side strap intermediate segment has an inner radius of about one inch or less.

16. A helmet system for protection of a wearer's head, comprising:

a ballistic shell having an interior;

a liner having a forward cap segment having an exterior surface which is fastened to the interior of the ballistic shell;

an eye shield assembly mounted to the exterior surface of the liner, and pivotable between a retracted position overlying the liner cap segment and positioned beneath the ballistic shell, and a deployed position overlying the eyes of the wearer, wherein the eye shield assembly has a frame, with at least one lens mounted thereto, and the frame has a first side arm which is pivotably connected to the liner cap segment at a first pivot mount above and forward of a wearer's first ear, and a second side arm which is pivotably connected to the liner cap segment at a second pivot mount above and forward of a wearer's second ear, and a first resilient band which extends from a fixed mount on the liner cap rearward of the first mount to a connection on the eye shield frame forward of the first mount, the first resilient band extending above the first pivot mount when the eye shield assembly is in the retracted position, and the first resilient band extending below the first pivot mount when the eye shield assembly is in the deployed position.

17. The helmet system of claim 16 further comprising a resilient gasket extending along lower portions of the eye shield frame, such that when the eye shield assembly is overlying a wearer's eyes the resilient gasket engages with the face of the wearer.

18. A helmet system for protection of a wearer's head, comprising:

a ballistic shell; and a face guard removably connected to the shell, the face guard having a frame which extends below the wearer's eyes and which covers portions of the wearer's nose to permit intake of air through said face guard, wherein portions of the frame define at least one concave outwardly and sidewardly opening rifle stock recess shaped to permit a rifle stock to be placed alongside the face guard and engaged within the recess to bring the rifle stock into close proximity to the wearer's face and to thereby permit the wearer to operate a rifle in a conventional fashion.

19. The helmet system of claim 18 wherein the rifle stock recess is defined by a sheet of flexible material secured to the face guard frame to overlie a rifle stock opening, the rifle stock opening being shaped to permit a rifle stock to be placed alongside the face guard and engaged with the sheet of flexible material to engage the rifle stock against the wearer's face with the sheet of flexible material between the wearer's face and the rifle stock.

* * * * *

UNITED STATES PATENT AND TRADEMARK OFFICE

CERTIFICATE OF CORRECTION

PATENT NO. : 6,804,829 B2
DATED : October 19, 2004
INVENTOR(S) : Caleb Clark Crye et al.

It is certified that error appears in the above-identified patent and that said Letters Patent is hereby corrected as shown below:

Title page,
Item [57], ABSTRACT,
Line 3, "28 . A" should be -- 28. A --

Drawings,
Replace Fig. 3 with the attached drawing sheet

Column 3,
Line 8, "at" should be -- α --
Line 13, "αis" should be -- α is --

Column 8,
Line 17, insert a comma after "segment"

Signed and Sealed this

Second Day of August, 2005

JON W. DUDAS
*Director of the United States Patent and Trademark Office*